US005195558A

United States Patent [19]

Liang

[11] Patent Number: 5,195,558

[45] Date of Patent: Mar. 23, 1993

[54] AUTOMATIC/MANUAL DOUBLE-FUNCTION URINAL FLUSH VALVE

[76] Inventor: Wen Liang, 3 Fl., No. 22, Lane 301, Sec. 3, Dah Duh Load, Peitou Dist., Taipei, Taiwan

[21] Appl. No.: 908,328

[22] Filed: Jul. 6, 1992

[51] Int. Cl.[5] ..... E03D 13/00; E03D 5/10

[52] U.S. Cl. ..... 137/549; 4/305; 137/599

[58] Field of Search ..... 137/599, 549; 251/129.04; 4/304, 305, DIG. 3

[56] References Cited

U.S. PATENT DOCUMENTS 3,193,846 7/1965 Lefebvre ..... 4/305
4,570,272 2/1986 Kawaguchi et al. ..... 4/305 X
4,709,728 12/1987 Ying-Chung ..... 251/129.04 X
5,062,453 11/1991 Saadi et al. ..... 251/129.04 X
5,092,560 3/1992 Chen ..... 251/129.04 X
5,095,941 3/1992 Betz ..... 251/129.04 X

*Primary Examiner*—Stephen M. Hepperle
*Attorney, Agent, or Firm*—Morton J. Rosenberg; David I. Klein

[57] ABSTRACT

An automatic/manual double-function urinal flush valve comprising a first flush port sealed by an electromagnetic valve controlled diaphragm, a second flush port sealed by a press rod controlled oscillating rod, wherein the press rod is pressed down, during power failure, to oscillate the oscillating rod in opening the second flush port, through which a flow of water is discharged to flush a urinal.

1 Claim, 3 Drawing Sheets

AUTOMATIC/MANUAL DOUBLE-FUNCTION URINAL FLUSH VALVE

BACKGROUND OF THE INVENTION

The present invention relates to valves, and more particularly the present invention relates to a urinal flush valve which can be operated fully automatically as well as manually.

A variety of urinal flush valves are known and used in public lavatories. These urinal flush valves are generally gathered into three categories: manual control type urinal flush valves, time control type urinal flush valves, and a fully automatic control type urinal flush valves. A manual control type urinal flush valve is controlled to flush a urinal by a rotary knob or press button. Because a manual control type urinal flush valve does not work automatically, people may forget or have less willing to open it. A time control type urinal flush valve is automatically controlled to regularly flush a urinal at equal time interval. This time control type of urinal flush valve operates automatically, however, it wastes much water. A fully automatic urinal flush valve is generally controlled by a heat inductor or an urine or infrared detector to automatically flush a urinal. A heat inductor or urine detector controlled urinal flush valve may be triggered by false signals. An infrared detector controlled urinal flush valve produces high reliability, and therefore it is widely accepted. Furthermore, the common disadvantage of the fully automatic urinal flush valves is that they can not work without electric power supply.

SUMMARY OF THE INVENTION

The present invention has been accomplished to provide a urinal flush valve which can be operated fully automatically as well as manually. According to one aspect of the present invention, there is provided an automatic/manual double-function urinal flush valve comprised of a first flush port sealed by an electromagnetic valve controlled diaphragm, a second flush port sealed by a press rod controlled oscillating rod, wherein the press rod is pressed down, during power failure, to oscillate the oscillating rod in opening the second flush port, through which a flow of water is discharged to flush a urinal. According to another aspect of the present invention, a retainer is provided to limit the up stroke of the reciprocating rod of the electromagnetic valve smoothly. According to still another aspect of the present invention, a sound trap groove is made on the inside to reduce noises upon each up stroke of the reciprocating rod in opening the first water passage port. According to still another aspect of the present invention, a wire gauze filter is provided to filtrate impurities from intake water. According to still another aspect of the present invention, all the parts inside the casing of the urinal flush valve can conveniently fastened into place or removed for repair work.

DETAILED DESCRIPTION OF THE PREFERRED EMBODIMENT

Figure 1:
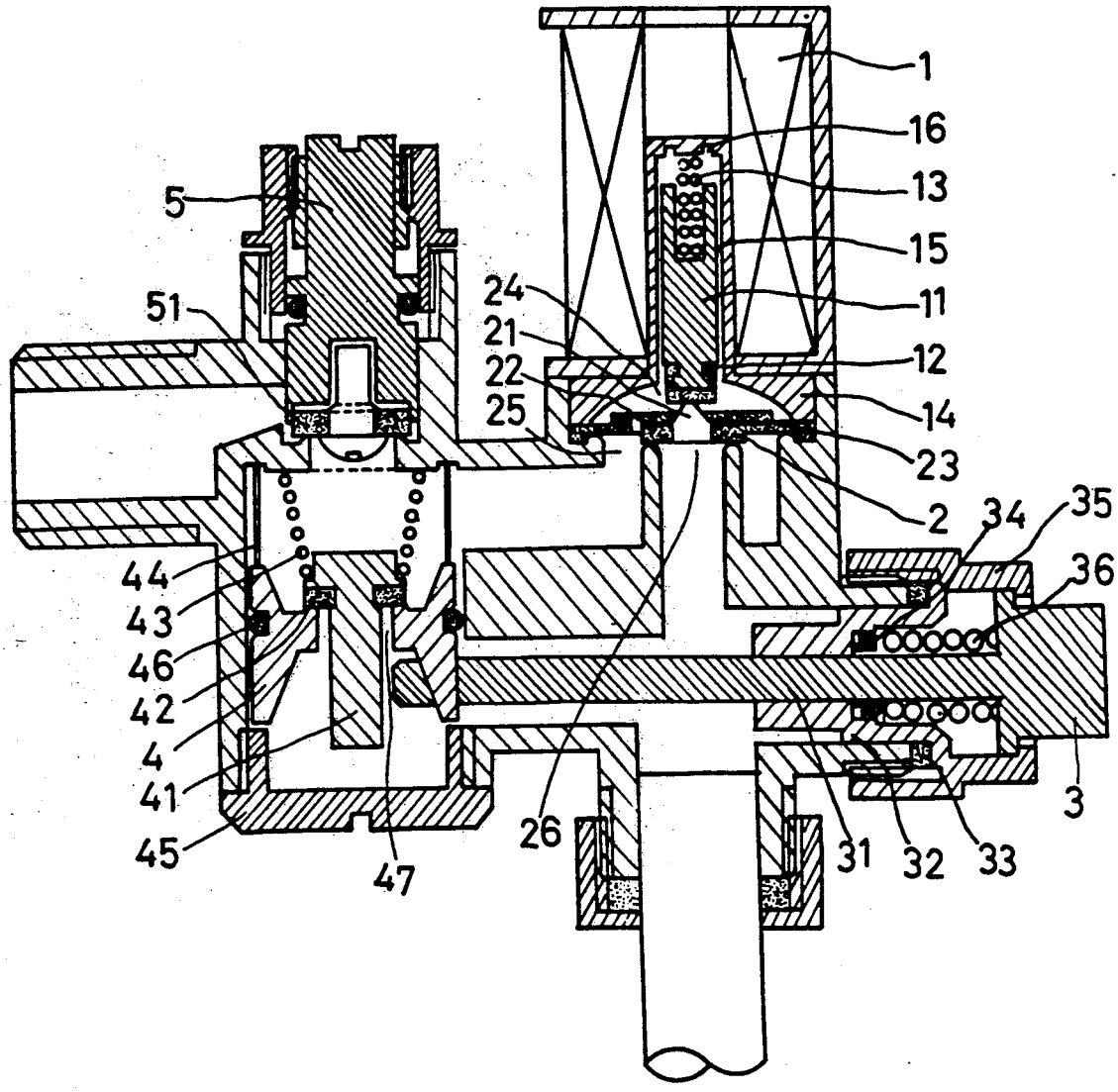
FIG. 1 is a sectional view of the preferred embodiment of the urinal flush valve of the present invention.

Referring to FIG. 1, the preferred embodiment of the urinal flush valve of the present invention is generally comprised of an electromagnetic valve 1, a diaphragm 2, a manual control knob 3, a manual flush control assembly 4, and a water flow rate regulating switch 5. The electromagnetic valve 1 is controlled to alternatively move a reciprocating rod 11. The reciprocating rod 11 is supported on a spring 13 and retained by a retainer 14 inside a sliding slot 15, having a water stopper 12, which is made from a flexible material, covered on the front end thereof. A sound trap groove 16 is made on the inside of the sliding slot 15 at the bottom to reduce noises upon each return stroke of the reciprocating rod 11. The diaphragm 2 which is fastened inside a diaphragm chamber 24 is comprised of a thin metal sheet 23 having a center hole 21 and an offset hole 22. The manual control knob 3 which is fastened to the casing of the urinal flush valve by a locknut 35 and supported on a spring 36 is comprised of a press rod 31 inserted through a hole (not shown) on a guide 32. The gap between the guide 32 and the casing of the urinal flush valve is sealed by a water seal ring 33; the gap between the guide 32 and the press rod 31 is sealed by a gasket ring 34. The manual flush control assembly 4 which is locked in place by a locknut 45 and externally sealed by a water seal ring 46 comprises an oscillating rod 41 attached with a water seal cushion 42 and supported on a spring 43. A wire gauze filter 44 is fastened inside the manual flush control assembly 4 to filtrate impurities from water. The water flow rate regulating switch 5 is a rotary type water flow rate controller having a water seal cushion 51 attached to the bottom end thereof.

Referring to FIG. 1 again, before the operation of the electromagnetic valve 1, the reciprocating rod 11 is forced by the spring 13 and water pressure to squeeze the water stopper 12 against the diaphragm 2 in sealing the center hole 21, and therefore water is stopped. At the same time, a flow of water flows from a water intake guide hole 25 into the diaphragm chamber 24 through the offset hole 22, permitting the water pressure at the diaphragm chamber 24 to be equilibrated with the water pressure at the water intake guide hole 25, and therefore the diaphragm 2 is stably retained at the valve port 26 to seal the passage way thereof.

Figure 2:
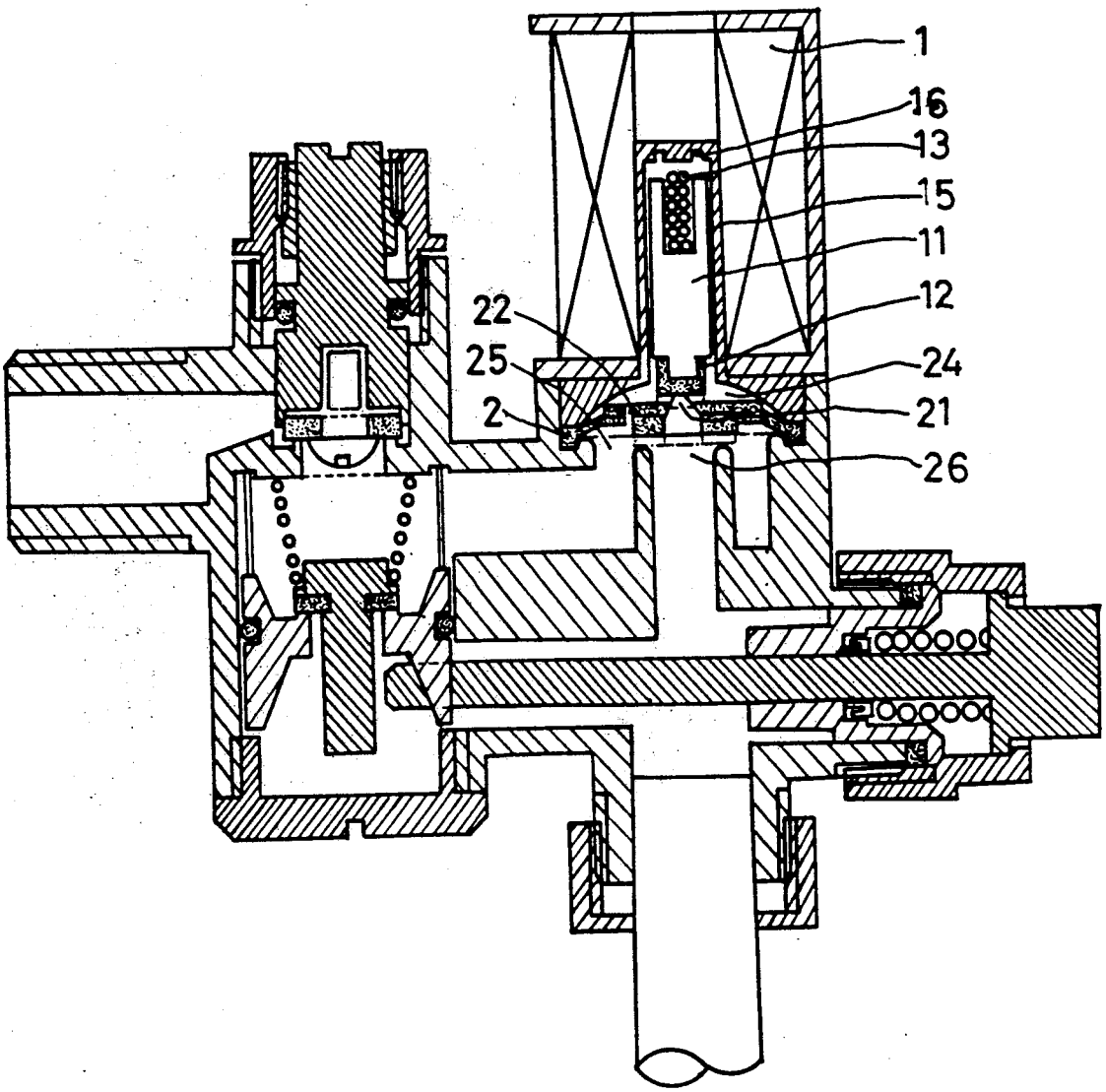
FIG. 2 illustrates that the urinal flush valve has been set at the mode of automatic control.

Referring to FIG. 2, once the electromagnetic valve 1 was triggered by an infrared control switch, the reciprocating rod 11 is attracted upwards to lift the water stopper 12 from the center hole 21 permitting a flow of water to be discharged from the diaphragm chamber 24 through the valve port 26. Because the center hole 21 has a inner diameter much larger than the offset hole 22, the diaphragm 2 is moved from the valve port 26 by the continuous intake flow of water permitting it to directly flow through the valve port 26 in flushing a urinal. The retainer 14 is designed in a curved shape to limit the up stroke of the reciprocating rod 11 within a fixed range. Once the reciprocating rod 11 was attracted by the magnetic force of the electromagnetic valve 1, a noise may be produced. By means of the arrangement of the sound trap groove 16, the noise level is greatly reduced. Once the electromagnetic valve 1 was electrically disconnected, the spring 13 automatically push the reciprocating rod 11 back to its original position in stopping the center hole 21 again. Because the diaphragm chamber 24 is kept in communication with the water intake guide hole 25 through the offset hole 22, the diaphragm 2 is smoothly moved downwards to seal the valve port 26.

Figure 3:
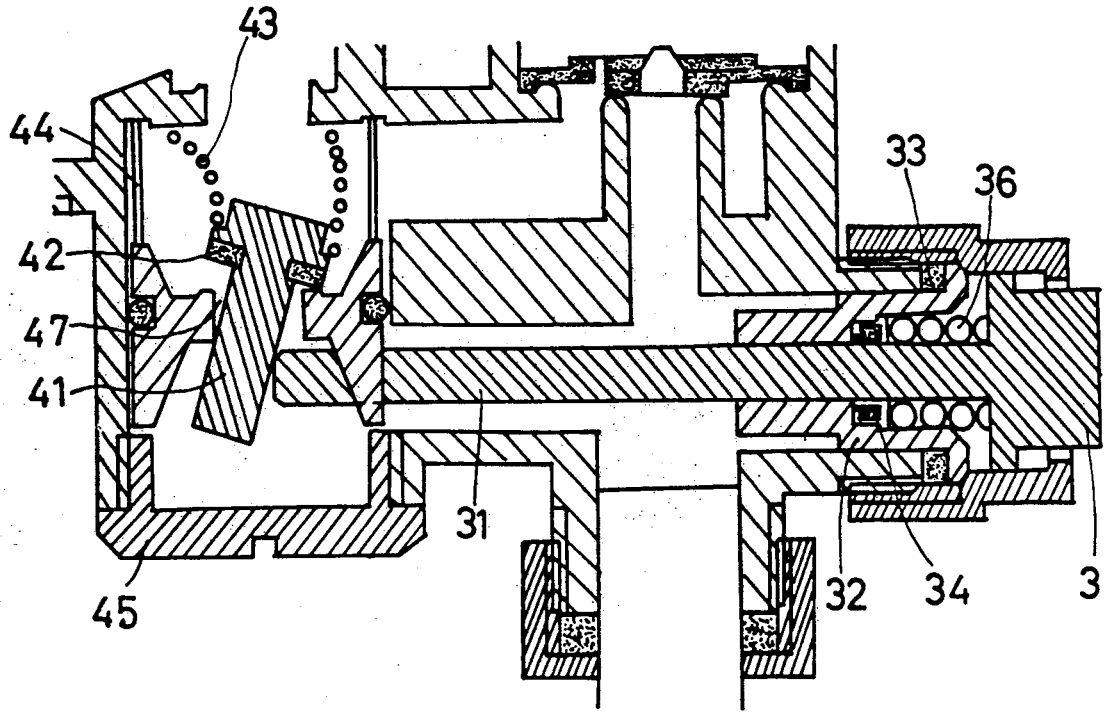
FIG. 3 illustrates that the urinal flush valve has been set at the mode of manual control.

Referring to FIG. 3, when power supply is disconnected or the infrared control switch fails to work properly, press the manual control knob 3 to move the oscillating rod 41 causing the water seal cushion 42 to open a water passage 47. When the water passage 47 opened, a flow of water is guided to flush the urinal. The wire gauze filter 44 and the internal structure of the manual flush control assembly 4 can be cleaned when the locknut 45 was removed from the casing of the urinal flush valve.

The electric control circuit which controls the operation of the electromagnetic valve 1 is of the known techniques and out of the scope of the present invention, and therefore it is not described further.

As indicated, the urinal flush valve of the present invention can be operated automatically as well as manually. The manual control mechanism is independently fastened inside the casing of the urinal flush valve without affecting the operation of the automatic control mechanism.

What is claimed is:

1. An automatic/manual double-function urinal flush valve comprising a water intake port controlled by a water flow rate regulator, a water discharge port through which water is discharged to flush a urinal, a first water passage port having one end connected to said water intake port and an opposite end connected to said water discharge port, a diaphragm stopped by an electromagnetic valve controlled reciprocating rod to seal said first water passage port, a second water passage port having one end connected to said water intake port and an opposite end connected to said water discharge port, a manual flush control assembly controlled by a manual control knob to seal said second water passage port, said manual flush control assembly comprising a valve seat locked inside said second water passage port by a locknut and externally sealed with a water seal ring, an oscillating rod attached with a water seal cushion and supported by a spring to seal a gap through said valve seat, and a wire gauze filter to filtrate impurities from water passing therethrough, said manual control knob being comprised of a press rod inserted through a hole on a guide fastened in place by a locknut and supported on a spring and sealed inside the urinal flush valve by water seal means with a head thereof extended out of the urinal flush valve, pressing on the head of said press rod causing said oscillating rod to open the gap on said valve seat permitting a flow of water to pass through said second water passage port toward said water discharge port for flushing the urinal.

* * * * *